US005159620A

United States Patent [19]

Bordelon

[11] Patent Number: 5,159,620

[45] Date of Patent: Oct. 27, 1992

[54] VARIABLE PITCH PROPELLER APPARATUS

[76] Inventor: Thomas Bordelon, 3005 DeLambert, Chalmette, La. 70043

[21] Appl. No.: 589,348

[22] Filed: Sep. 28, 1990

[51] Int. Cl.[5] ..... B63H 1/06

[52] U.S. Cl. ..... 416/167; 416/164; 416/135; 416/147; 416/149

[58] Field of Search ..... 416/167, 164, 135, 147, 416/149, 163

[56] References Cited

U.S. PATENT DOCUMENTS

| | | | |
|---|---|---|---|
| 1,491,589 | 4/1924 | Dzus | 416/163 X |
| 2,850,106 | 9/1958 | Swan | 416/163 X |
| 3,295,610 | 1/1967 | Frias | 416/167 X |
| 3,367,424 | 2/1968 | Fukasu et al. | 416/147 |
| 3,792,937 | 2/1974 | Chilman | 416/167 |
| 3,912,417 | 10/1975 | Herbert | 416/167 |
| 4,545,734 | 10/1985 | Schilder | 416/167 X |
| 4,810,166 | 3/1989 | Sawizky et al. | 416/167 |

FOREIGN PATENT DOCUMENTS

| | | | |
|---|---|---|---|
| 949899 | 9/1956 | Fed. Rep. of Germany | 416/147 |
| 0203897 | 11/1984 | Japan | 416/164 |
| 0135988 | 6/1986 | Japan | 416/147 |
| 474164 | 6/1975 | U.S.S.R. | 416/147 |

*Primary Examiner*—Edward K. Look
*Assistant Examiner*—Todd Mattingly
*Attorney, Agent, or Firm*—Thomas S. Keaty

[57] ABSTRACT

The invention relates to a propeller assembly, particularly suitable for use with axial flow pumps. The propeller assembly is provided with a cam-operated rotatable propeller blade compression shaft which rotates in response to a detected increase load on the propeller blade. An elongated rod connected to a power source transmits movement to a spring which, in turn, transmits the movement to the cam. To accommodate tilting of the propeller blade during changing of the pitch, a hub outer surface is formed convex and the inner surface of the enclosing shroud is formed concave. The radii of curvature of the hub and the shroud are generally complementary to the radius of curvature of the inner and outer surfaces of the propeller blade, respectively.

17 Claims, 1 Drawing Sheet

VARIABLE PITCH PROPELLER APPARATUS

BACKGROUND OF THE INVENTION

The present invention relates to pumping apparatuses, and more particularly to revolving propeller units for axial flow propeller pumps driven by a hydraulic motor as well as conventional extended shaft pumps.

Axial flow pumps are widely used in the industry for storm drainage, pumping transfer, irrigation, flood control, construction de-watering and the like. Axial flow pumps are often utilized in submersible installations, wherein the main drive unit is positioned on the surface, while the pump itself, having a propeller unit connected through a short internal shaft to a sealed hydraulic motor is submerged under water. The main power drive unit produces high pressure oil which is conduited down to the hydraulic motor of the submerged unit, so as to rotate the pump propeller with a certain number of revolutions per minute. The required revolutions of the propeller directly depend on the amount of load on the propeller and the head, that is the amount of water pumped by the submerged unit. However, such arrangement suffers from a certain disadvantage, when the amount of pressure delivered to the submersed unit is not proportional to the amount of load on the propeller, at which time the main driving unit operates at its full capacity when there is no need for it. For example, such situation may occur when a high power unit is positioned on the surface of a spillway to drain a small amount of water from one water body across the spillway to the other water body. The high powered unit continues to operate, as if it were driving an axial flow pump designed to pump a great amount of water, when there is actually no need for such high pressure to be delivered to the submerged unit. Apparently, such situation wears out the main driving unit and the increased revolutions of the shaft may damage and destroy the safety valve on the hydraulic oil supply. An acceptable practice in such cases was to reduce the revolutions of the main driving motor, allowing the relief valve to relieve the excessive pressure and detain the revolutions of the main driving unit on the same level but most of the oil that is being driven by the hydraulic unit is wasted just circulating back to the unit, causing an increased thermal build-up.

The present invention contemplates provision of a propeller unit which can vary the pitch of the propeller, depending on the amount of load on the propeller in any particular situation automatically, without the need for manual adjustment.

SUMMARY OF THE INVENTION

The present invention achieves its objects and overcomes shortcomings of the prior art by providing a propeller assembly which comprises means for changing pitch of the propeller proportionally to the amount of load which the propeller is pumping at any particular moment. The propeller assembly comprises a hub portion which has (in longitudinal cross section), a convex surface which is designed to complement the radius of curvature of the inner most end of a rotating blade carried by the hub portion. The convex surface accommodates tilting of the propeller during the changing of the propeller pitch.

Extending co-axially within the hub is a hollow shaft which receives in a slidable engagement therein an elongated rod, an upper end of which is connected to the power source. A lower end of the elongated rod contacts a bottom surface of a spring-biased cup which, in turn, contacts a bottom of the hub. The cup is provided with outwardly transversely extending lip and a cylindrical portion. A compression spring is mounted about the cylindrical portion and urges with its upper end against the bottom surface of the transverse circumferential lip.

A retaining cap encloses the spring-biased cup and the compression spring and is fixedly attached to the hub in circumferentially enclosing relationship to the cup and the spring. At least one propeller blade is attached to the hollow shaft by a propeller blade shaft which extends transversely to a vertical longitudinal axis of the hollow shaft.

A cam member is fixedly attached to the propeller blade shaft and contacts an upper end of a cam rod, a lower end of which extends through the hub and contacts an upper surface of the circumferential lip of the spring-biased cup. When the change in the load on the propeller blade is detected, the cam member acts on the cam rod, pushing it against the cup which moves away from the hub, transmiting the force to the compression spring, compressing it and allowing the elongated rod in the hollow shaft to move downwardly through the hollow shaft and to decrease pressure created by the power source.

In order to limit effect of centrifugal force on the blade shaft and on the propeller blade, a groove is formed in the innermost end of the blade shaft adjacent the point of its attachment to the hollow shaft, and a plurality of spherical members, such as steel balls, are deposited in the groove.

In order to accommodate possible tilting of the propeller blade during changing of the pitch a shroud or enclosure which houses the propeller assembly is formed with a concave inner surface.

The propeller assembly is designed to be attached to a power source by its upper end and, by its lower end, to an intake bell, which receives the flow of the liquid being pumped through its open bottom end.

It is therefore an object of the present invention to provide a propeller assembly having means for automatically changing pitch of the propeller.

It is a further object of the present invention to provide a means for accommodating tilting of the propeller blade during change of the pitch.

It is still a further object of the present invention to provide means for limiting effect of centrifugal force on the propeller blade.

These and other objects of the present invention will be more apparent to those skilled in the art from the following detail description of the invention.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
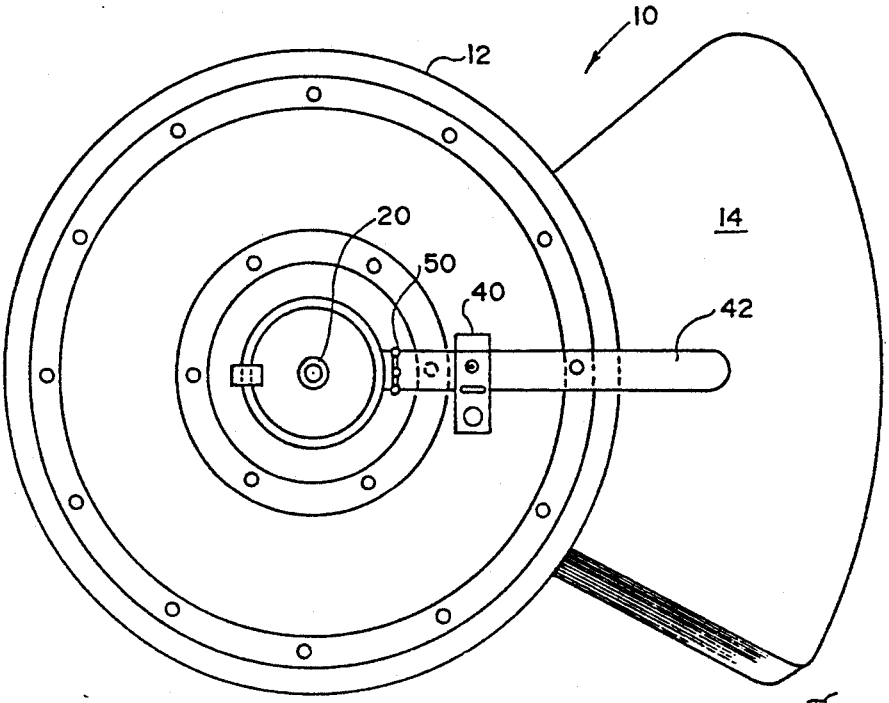
FIG. 1 is a top plan view of the propeller apparatus in accordance with the present invention.

Referring to the drawings in more detail, the propeller assembly in accordance with the present invention is generally designated by numeral 10. The propeller assembly 10 comprises a hub portion 12, which carries two or more propeller blades 14, both the hub 12 and the blades 14 enclosed in a housing or shroud 16. Although not shown, but apparent to those skilled in the art, the shroud 16 is adapted to be connected at its upper portion to a power source, such as a hydraulic motor assembly and, at its bottom portion, to an open bottom intake bell (schematically illustrated in FIG. 2 and designated by numeral 15).

The hub 12 comprises a hollow shaft 18 through which an elongated rod 20 extends. The shaft 18 and the hub 12 are locked together through the use of keyway 19. A lower part of the shaft 18 is threadably engaged by threads 21 with a hub retaining nut 23 to retain the hub 12 and the shaft 18 together. At its upper end the rod 20 is connected to the motor unit (not shown), while at its lower end it urges against a generally U-shaped spring-biased cup 22. The cup 22 has upwardly extending generally cylindrical wall 24 which is integrally connected to a transverse circumferential lip 26. The cylindrical wall 24 of the cup 22 is surrounded by a tension coil spring 28, the top end of which urges against the bottom surface of the lip 26, while the lower end of which is forced against the bottom of a retaining cap 30. The cap 30 encloses the cup 22 and its surrounding coil spring 28 and is attached, such as by bolts 32 to the hub 12.

The cup 22 is adapted for a limited axial movement (towards and away from the hub 12) in response to a force applied by a rod 20 on the bottom of the cup 22, acting against the bottom surface 34 thereof.

Figure 2:
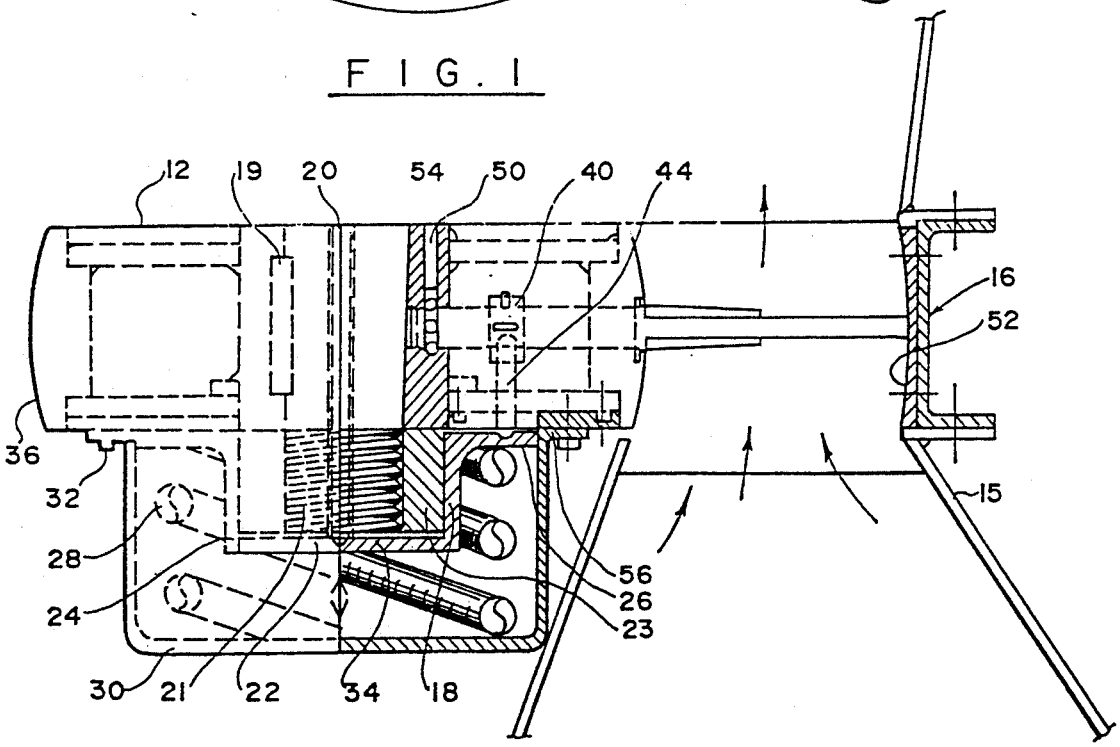
FIG. 2 is a longitudinal sectional side view of the propeller apparatus.
Figure 3:
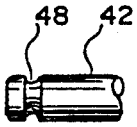
FIG. 3 is a detail partial view of a blade shaft connecting a propeller blade to the hub.
Figure 4:
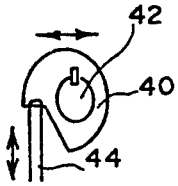
FIG. 4 is a detail perspective view of a cam assembly utilized in the present invention.

The hub 12 has an external surface 36 which, as can be seen in FIG. 2, is formed convex outwardly. The convex surface allows to accommodate variable pitch of the propeller blade 14, by forming an arch against which the blade moves as it tilts while rotating. Conventional cylindrically shaped hubs do not have such advantage and cannot successfully accommodate the tilting of the propeller blades 14.

The changing of the pitch (tilting) of the propeller blade is achieved by provision of a spring-affected cam assembly 40 which is substantially mounted inside the hub 12 and is fixedly attached to a propeller blade shaft 42. The cam assembly 40 comprises a push rod 44 which contacts at its lower end the upper surface of the lip 26 and contacts, at its upper end, a cam member 46. When the cup 22 is forced down by the rod 20, compressing the spring 28, the cam pushing rod 44 moves downwardly, allowing the cam to slightly rotate and change its position, thereby forcing the shaft 42 and the blade 14 which is carried by the shaft 42 to tilt and change the pitch, or tilt of the propeller blade 14. The rod 20 is engaged within a cylindrical retaining member 21 which occupies substantially entire space within the cup 22.

The blade shaft 42 extends, at its innermost end towards the propeller hollow shaft 18 and, at its outer end, outwardly from the hub 12 to be connected to the blade 14. The above described cam assembly 40 is mounted on the shaft 42 inside the hub 12. The shaft 42, adjacent its innermost part connecting it to the propeller shaft 18 is provided with a concave groove 48 about the circumference thereof and a plurality of steel balls 50 are positioned within the groove 48. When the shaft rotates, a centrifugal force is created and acted on the shaft 42 and the associated propeller blades 14. The balls 50 intercept the direction of the centrifugal force and provide a locking mechanism, as well as rotation facilitating means to the shaft 42 to minimize the action of the centrifugal force caused by rotation of the shaft.

In order to position the balls 50 within the groove 48, an opening 54 is formed from the top surface of the hub 12 towards the level at which the groove 48 of the shaft 42 is to be located. Then the balls 50 are simply deposited through the opening 54, which is subsequently closed to retain the balls 50 in the predetermined place in relationship to the shaft 42.

Additional feature of the present invention is provision of a concave-shaped inner surface 52 of the shroud or housing 16. As the propeller tilts and moves about the exterior surface 36 of the hub 12, the concave surface 52, which has generally the same radius of curvature as the exterior of the blade 14, helps to accommodate the changing pitch of the propeller blades 14.

The present invention further contemplates that the spring 28 would act as a shock absorber against a force acted on the blade 14 should it meet any obstruction. In this manner, the spring will be compressed more than it is necessary for the changing of the pitch of the propeller blade 14 to accommodate such sudden impact. It will be easily appreciated that such impact with an obstruction can easily cause damage to the seals, bearings and even the shaft.

Since the propeller unit 10 is designed to act in a partially submerged environment, it is important that the hub 12 be sealed against moisture. Such conventional sealing means as O-rings 56 positioned between the cap 30 and the hub 12 would ensure a water tight seal on the hub 12.

Prior to placing the propeller assembly 10 into operation, a one time adjustment of the delicate cam balancing mechanism is made to adjust the pressure acting on the spring 28, which effectively acts on the cam pushing rod 44. This adjustment is made depending on the type of the hydraulic motor and the difference in pressure that such motor can create in its operating mode.

Many changes and modifications can be made within the design of the present invention without departing from the spirit thereof. I therefore pray that my rights to the present invention be limited only by the scope of the appended claims.

I claim:

1. A propeller assembly for a pump, comprising:

a hub having a substantially convex outer surface;

a central hollow shaft means co-axially mounted inside the hub and adapted to receive torque from a power source, said shaft receiving an elongated rod connected to the power source;

a string-biased cup means adapted for a limited axial movement towards and away from the hub, said cup means having an outwardly extending lip, an upper surface of which contacts a bottom surface of the hub when the cup is in its normal operating position;

at least one propeller blade attached to said shaft means by a propeller blade shaft; and means for changing tilt of the propeller blade, said means for changing extending at least in part through said hub, said means for changing comprising a cam assembly having a cam rod extending through a bottom wall of the hub and contacting an upper surface of the cup lip by a lower end of the cam rod, and a cam member fixedly attached to said propeller shaft, said cam member being movable by an upper end of the cam rod, said cam member transmitting movement of said cam rod to said propeller blade shaft.

2. The apparatus of claim 1, wherein said cam assembly is carried by said propeller blade shaft, said cam assembly contacting said cup means and moving when the cup means is moved away from said hub by the elongated rod, thereby causing a limited rotation of the propeller blade shaft about an axis formed by the propeller blade shaft.

3. The apparatus of claim 2, wherein a lower end of said elongated rod is co-axially received in said cup means and contacts a bottom inner surface of the cup means.

4. The apparatus of claim 1, further comprising a compression spring means normally forcing said cup means into contact with said hub, said spring means acting on a lower surface of the cup lip.

5. The apparatus of claim 4, further comprising a retaining cap means co-axially fixedly attached to said hub and substantially enclosing said cup means and the compression spring means.

6. The apparatus of claim 5, wherein said spring means has a lower end which urges against an inner bottom surface of the retaining cap means.

7. The apparatus of claim 1, wherein said blade has an arcuate inner part, and wherein a radius of curvature of said hub convex outer surface is complementary to the radius of the arcuate blade inner part.

8. The apparatus of claim 1, further comprising a shroud means for enclosing the propeller assembly, said shroud means having a concave inner surface to accommodate tilting of the propeller blade during changing of the propeller tilt.

9. A propeller assembly for a pump, comprising:

a hub having a substantially convex outer surface;

a central hollow shaft means co-axially mounted inside the hub and adapted to receive torque from a power source, said shaft receiving an elongated rod connected to the power source;

a spring-biased cup mans adapted for a limited axial movement towards and away from the hub, said cup means having an outwardly extending lip, an upper surface of which contacts a bottom surface of the hub when the cup is in its normally operating position;

at least one propeller blade attached to said shaft means by a propeller blade shaft;

means for changing tilt of the propeller blade, said means for changing the tilt extending at least in part through said hub; and means for limiting effect of a centrifugal force on the propeller blade comprising a plurality of spherical members positioned within a circumferential groove formed in the propeller blade shaft adjacent an innermost end of the propeller blade shaft, inwardly from said means for changing tilt of the propeller blade, said propeller assembly being mounted in a pump housing.

10. A propeller assembly for a pump, comprising:

a hub having a substantially convex outer surface;

a central hollow shaft means co-axially mounted inside the hub and adapted to receive torque from a power source, an elongated rod extending through said hollow shaft in axial slidable engagement therewith, a lower end of said elongated rod extending through a bottom of the hub;

a spring-biased cup means adapted for a limited axial movement towards and away from the hub, said cup means having an outwardly extending annular lip, an upper surface of which contacts a bottom surface of the hub when the cup is in its normally operating position, the lower end of said elongated rod contacting a bottom of said cup means;

at least one propeller blade attached to said shaft means by a propeller blade shaft; and means for changing tilt of the propeller blade mounted substantially within said hub and allowing to change the tilt of the propeller blade, said means for changing pitch of the propeller comprising a cam assembly carried by said propeller blade shaft, said cam assembly contacting said cup means and moving when the cup means moves away from said hub under an influence of a force applied by the elongated rod, said cam assembly comprising a cam rod extending through a bottom wall of the hub and contacting an upper surface of the cup lip by a lower end of the cam rod, and a cam member fixedly attached to said propeller shaft, said cam member being rotatable by an upper end of the cam rod, transmiting rotational movement to said propeller blade shaft.

11. The apparatus of claim 10, further comprising a compression spring means normally forcing said cup means into contact with said hub, said spring means acting on a bottom surface of the cup lip.

12. The apparatus of claim 11, further comprising a retaining cap means co-axially fixedly attached to said hub and substantially circumferentially enclosing said cup means and the compression spring means.

13. The apparatus of claim 12, wherein said spring means has a lower end which urges against an inner bottom surface of the retaining cap means.

14. The apparatus of claim 10, further comprising a shroud means for enclosing the propeller assembly, said shroud means having a concave inner surface to accommodate movement of the propeller blade during changing of the propeller blade tilt.

15. The apparatus of claim 10, further comprising means for limiting effect of a centrifugal force on the propeller blade.

16. The apparatus of claim 15, wherein said means for limiting effect of centrifugal force comprise a plurality of spherical members positioned within a circumferential groove formed in the propeller blade shaft adjacent an innermost end of the propeller blade shaft.

17. The apparatus of claim 10, wherein said propeller blade has an arcuate inner part, and wherein a radius of curvature of said hub outer surface is complementary to a radius of the arcuate blade inner part.

* * * * *